US007021526B2

(12) United States Patent
Nishikawa et al.

(10) Patent No.: US 7,021,526 B2
(45) Date of Patent: Apr. 4, 2006

(54) PACKAGING CASE

(75) Inventors: Youichi Nishikawa, Tokyo (JP); Yousuke Tagami, Tokyo (JP); Taku Furuta, Osaka (JP); Hiromu Ikeda, Osaka (JP)

(73) Assignee: Rengo Co., Ltd., Osaka (JP)

( * ) Notice: Subject to any disclaimer, the term of this patent is extended or adjusted under 35 U.S.C. 154(b) by 0 days.

(21) Appl. No.: 10/382,623

(22) Filed: Mar. 7, 2003

(65) Prior Publication Data

US 2003/0173398 A1 Sep. 18, 2003

(30) Foreign Application Priority Data

Mar. 12, 2002 (JP) ..... 2002-066995

(51) Int. Cl.
*B65D 5/00* (2006.01)
*B65D 1/00* (2006.01)

(52) U.S. Cl. ..... 229/406; 229/107; 229/902; 229/938

(58) Field of Classification Search ..... 229/938, 229/902, 406, 107, 142, 145
See application file for complete search history.

(56) References Cited

U.S. PATENT DOCUMENTS 489,858 A * 1/1893 Donaldson ..... 220/23.4
1,158,046 A * 10/1915 Haines ..... 229/107
1,945,013 A * 1/1934 Wilson ..... 220/574
2,064,590 A * 12/1936 Cunningham ..... 229/108
2,073,498 A * 3/1937 Seez ..... 131/240.1
2,687,246 A * 8/1954 Randall ..... 229/406
3,222,190 A * 12/1965 Davis ..... 426/120
3,355,082 A * 11/1967 Wood ..... 294/131
3,446,416 A * 5/1969 Epstein ..... 206/557
5,205,476 A 4/1993 Sorenson
5,226,587 A 7/1993 Eisman et al.
5,379,934 A 1/1995 Lorenz
6,415,944 B1 * 7/2002 Toussant ..... 220/574

* cited by examiner

*Primary Examiner*—T. Mai
(74) *Attorney, Agent, or Firm*—Foley & Lardner LLP

(57) ABSTRACT

A packaging case 1 is formed of a unitary blank 1*a* of paper material. The unitary blank 1*a* has at least two fold lines 2*a*, 2*b* between which a back side wall 6*a* is formed and both sides of which a bottom wall 10 and a top wall 11 are formed. The unitary blank 1*a* has also incisions 3*a*, 3*b* formed on both ends of the fold lines 2*a*, 2*b*. The unitary blank is deep drawn to form side walls 6 on each periphery of the bottom wall 10 and the top wall 11 and form rims 8*a*, 8*b* protruding outwardly from each upper end of the side walls 6. The unitary blank is folded along the fold lines 2*a*, 2*b* so that the rims 8*a*, 8*b* come into contact with each other, whereby the bottom wall 10, the top wall 11, the back side wall 6*a* and the side walls 6 constitute an inner space.

13 Claims, 12 Drawing Sheets

PACKAGING CASE

BACKGROUND OF THE INVENTION

The present invention relates to a packaging case for packing a content such as pizza and hamburger, the packaging case being made from paper material and comprising a container integrated with a lid.

Conventionally, as a packaging case being made from paper material and comprising a container integrated with a lid, there are known packaging cases as disclosed in U.S. Pat. Nos. 5,205,476, 5,226,587 and 5,379,934. These packaging cases are formed by stamping paper material to form flaps on the periphery thereof and erecting the flaps to form side walls.

However, the above conventional packaging cases have a disadvantage that it is difficult to erect the flaps, making a fabricating work troublesome.

SUMMARY OF THE INVENTION

It is an object of the present invention to provide a packaging case comprising a container integrated with a lid, the packing being formable by deep-drawing the paper material.

As a means for solving the object, the present invention provide a packaging case formed of a unitary blank of paper material comprising a bottom wall, a top wall and a back side wall connecting the bottom wall and the top wall, the unitary blank having:

at least two fold lines between which the back side wall is formed and both sides of which the bottom wall and the top wall are formed; and incisions formed on both ends of the fold lines; wherein the unitary blank is deep drawn to form side walls on each periphery of the bottom wall and the top wall and form rims protruding outwardly from each upper end of the side walls, and wherein the unitary blank is folded along the fold lines so that the rims come into contact with each other, whereby the bottom wall, the top wall, the back side wall and the side walls constitute inner space.

According to the present invention, the unitary blank is valley folded along the fold lines to form an inner space comprising the bottom wall, the top wall and the side walls, whereby a packaging case comprising a container integrated with a lid can be easily made.

BRIEF DESCRIPTION OF THE DRAWINGS

Other objects and features of the present invention will become clear from the following detail description with reference to the accompanying drawings in which.

DETAILED DESCRIPTION OF THE PREFERRED EMBODIMENT

An embodiment of the present invention will be described below with reference to the accompanying drawings.

Figure 1:
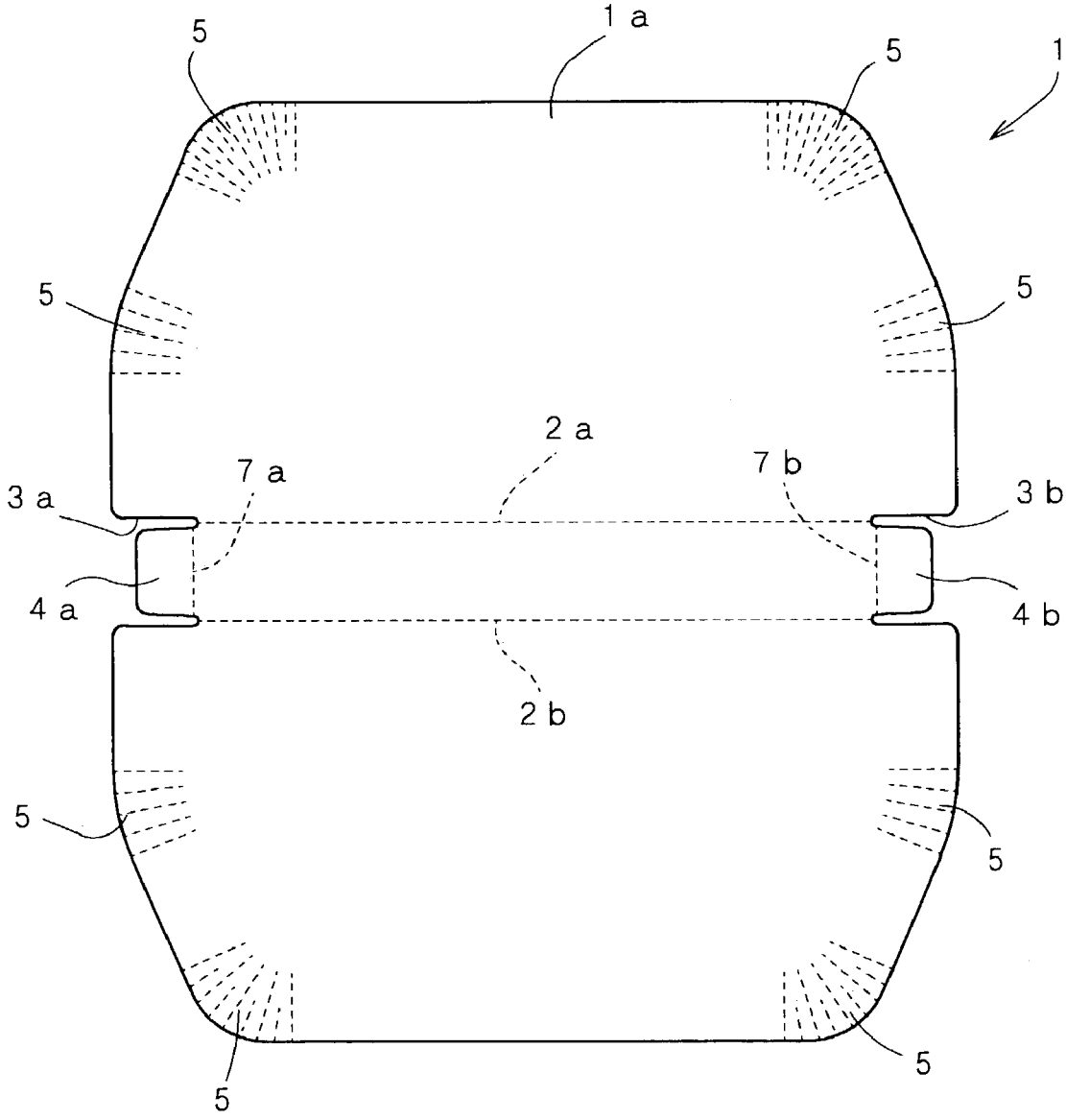
FIG. 1 is a developed view of a packaging case according to an embodiment of the present invention.

FIG. 1 is a developed view of a packaging case 1 according to an embodiment of the present invention. The packaging case 1 is made of a unitary blank 1*a* of paper material such as corrugated board. In the present embodiment, an E-fluted corrugated board having a thickness of 1.5 mm is used. On the center portion of the blank 1*a* are provided fold lines 2*a*, 2*b*. Bend line 7*a*, 7*b* connecting the fold lines 2*a*, 2*b* are also provided on the both end portions of the fold lines 2*a*, 2*b*. The fold lines 2*a*, 2*b* and the bend line 7*a*, 7*b* are formed when cutting the blank 1*a*, for example, by pressing press-ruling portions provided on the lower surface of a wooden upper mold unshown onto the unitary blank 1*a* to crush it. On both ends of the fold lines 2*a*, 2*b*, incisions 3*a*, 3*b* are formed. The incisions 3*a*, 3*b* extend from the outer periphery of the blank 1*a* to the both ends of the bend lines 7*a*, 7*b* so that inner fins 4*a*, 4*b* are formed outside the bend lines 7*a*, 7*b*.

Figure 2:
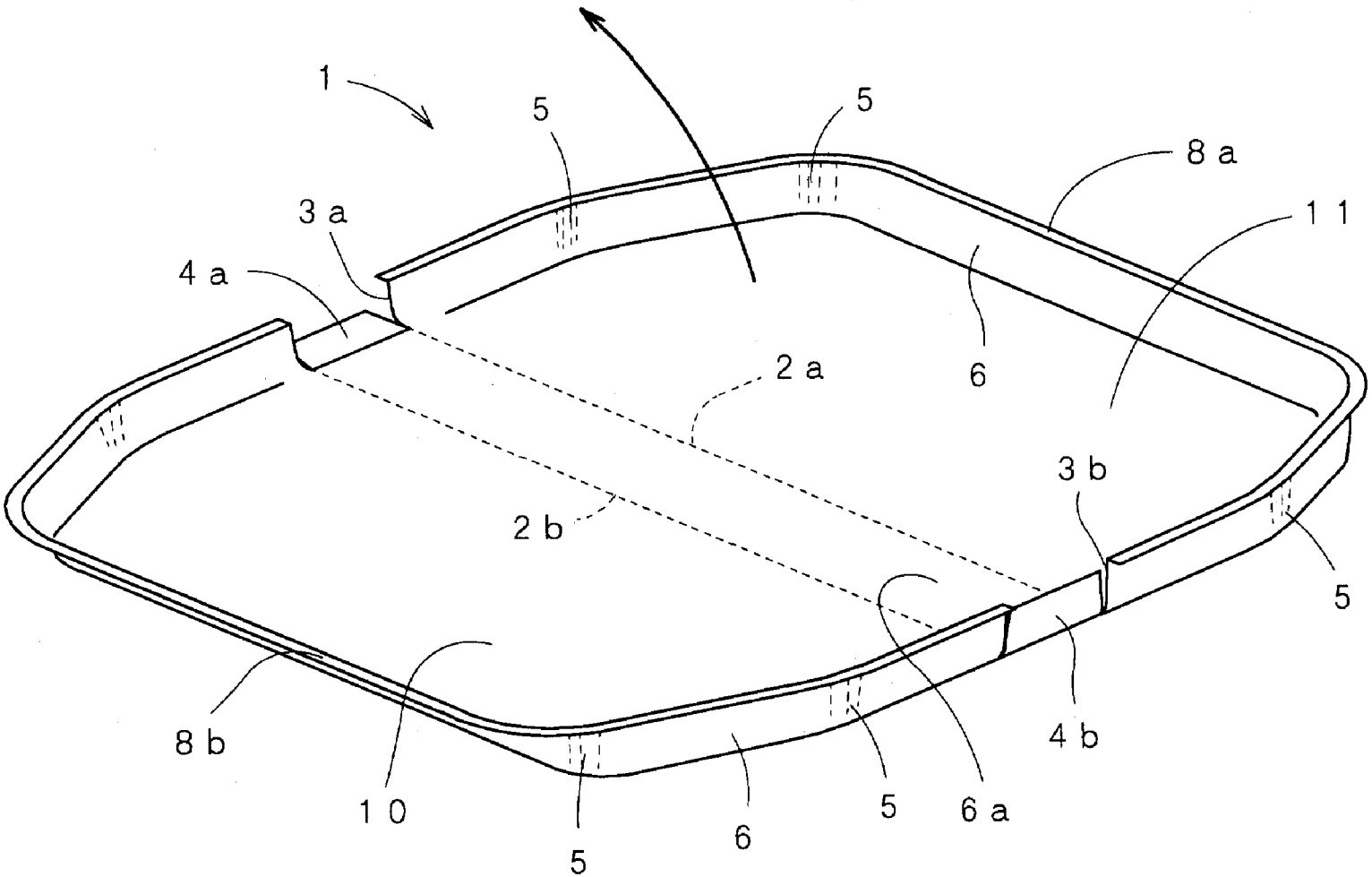
FIG. 2 is a perspective view showing a deep-drawn state of the packaging case of FIG. 1.

On the outer periphery of the blank 1*a*, as shown in FIG. 1, are provided roulette processed portions 5 which extend to a predetermined distance from the outer periphery of the blank 1*a*. By means of the deep-drawing process of the blank 1*a*, as shown in FIG. 2, a bottom wall 10 and a top wall 11 are formed on both sides of the fold lines 2*a*, 2*b*, side walls 6 on the periphery of the packaging case 1 and rims 8*a*, 8*b* outwardly extending from the upper ends of the side walls 6 are also formed. The roulette processed portions 5 constitute curved portions of the side walls 6. The incisions 3*a*, 3*b* prevent the blank 1*a* from being torn at the time of the deep-drawing process. A back side wall 6*a* is formed between the fold lines 2*a*, 2*b*.

Figure 3A:
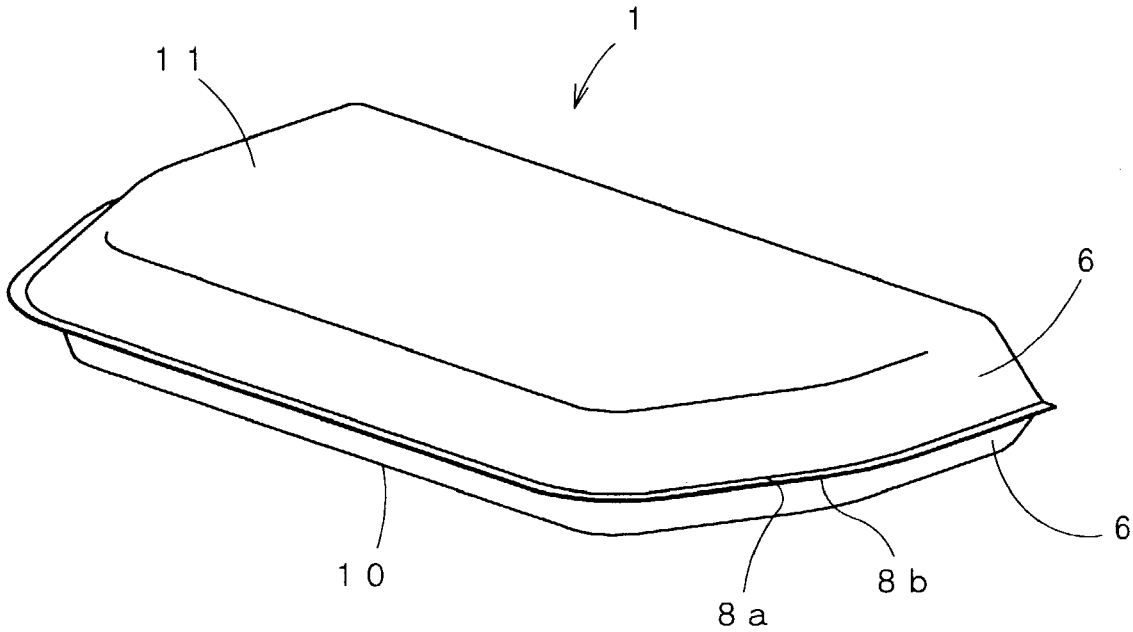
FIG. 3A is a perspective view showing a closed state of the packaging case of FIG. 2.
Figure 3B:
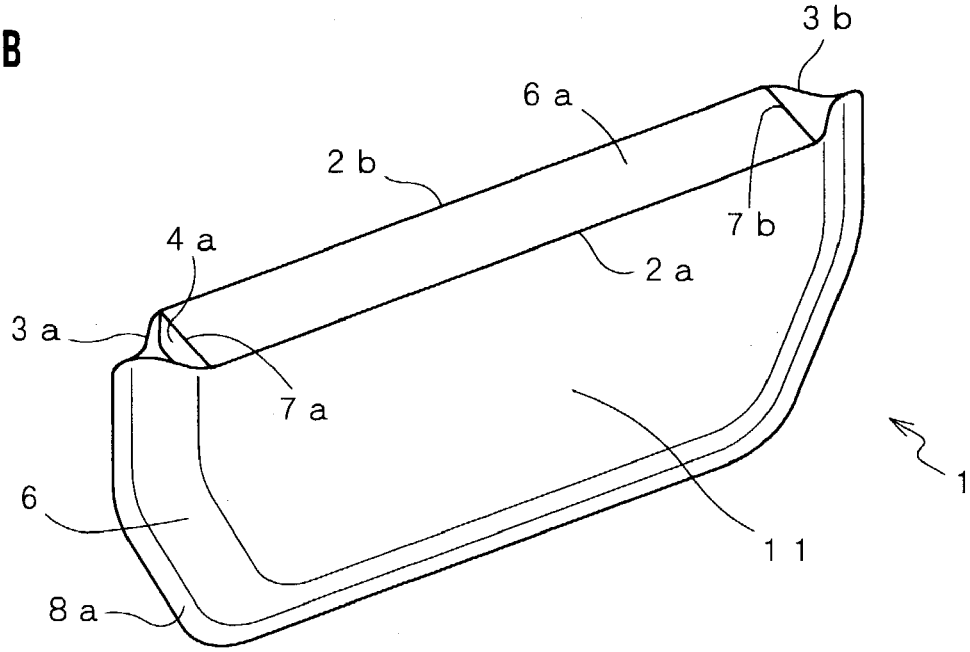
FIG. 3B is a perspective view from a different angle of the packaging case of FIG. 3A.

When putting contents in the packaging case 1, the inner fins 4*a*, 4*b* are valley folded along the bend lines 7*a*, 7*b* (shown in FIG. 1) and then the packaging case 1 is also valley folded along the fold lines 2*a*, 2*b* so that the rims 8*a*, 8*b* come into contact with each other as shown in FIG. 3. Thus, the bottom wall 10, the top wall 11, the back side wall 6*a* and the side walls 6 of the packaging case 1 make an inner space in which the contents are contained. The inner fins 4*a*, 4*b* come into contact with the inner surfaces of the bottom wall 10 and the top wall 11, preventing the packaging case 1 from being crushed. The bottom wall 10 and the top wall 11 are fastened by appropriate fastening means such as rubber band and tape. When removing the fastening means, the top wall 11 is opened due to the repulsive force of the corrugated board, which allows the contents to be easily taken out.

Figure 4A:
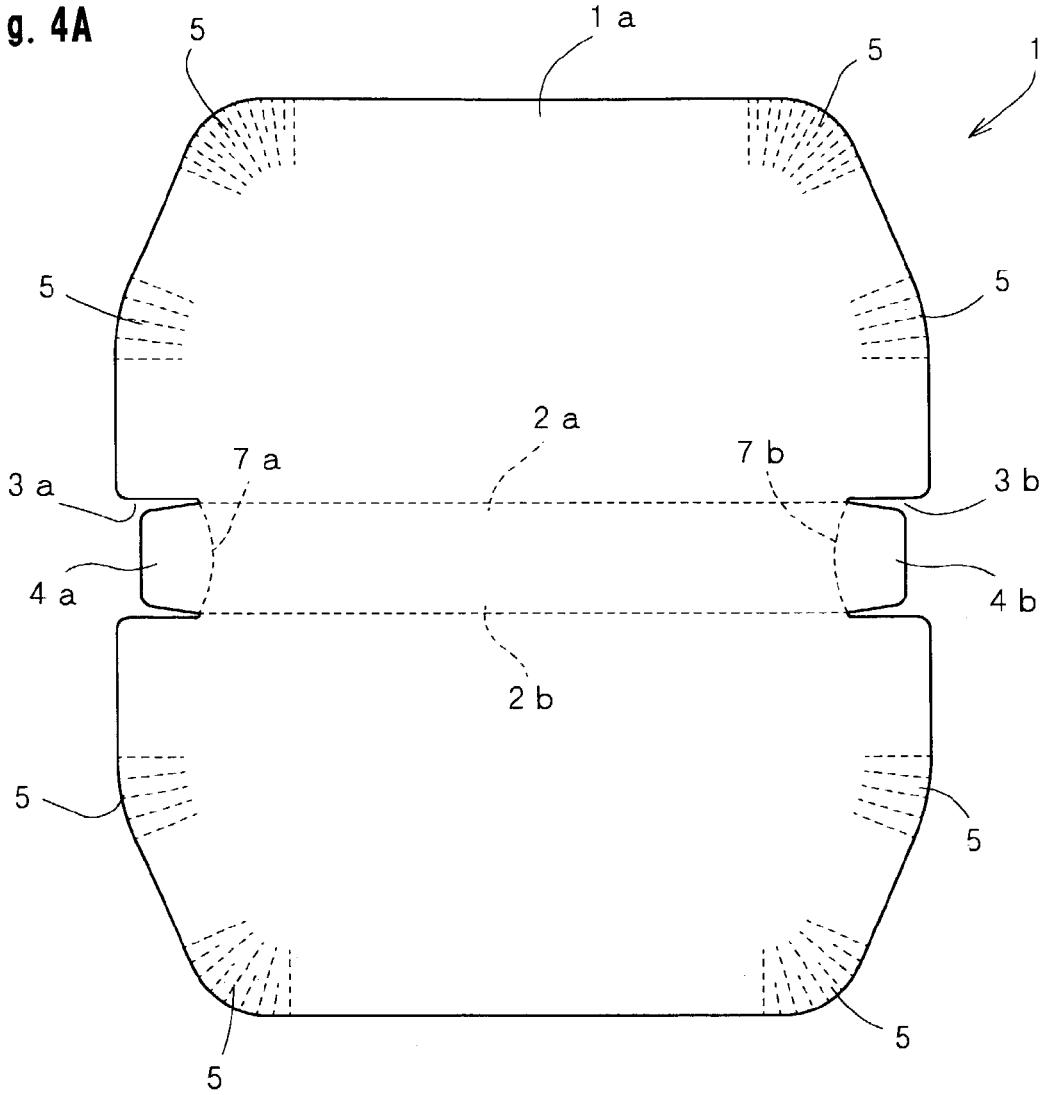
FIG. 4A is a developed view showing a variation of the packaging case of FIG. 1.
Figure 4B:
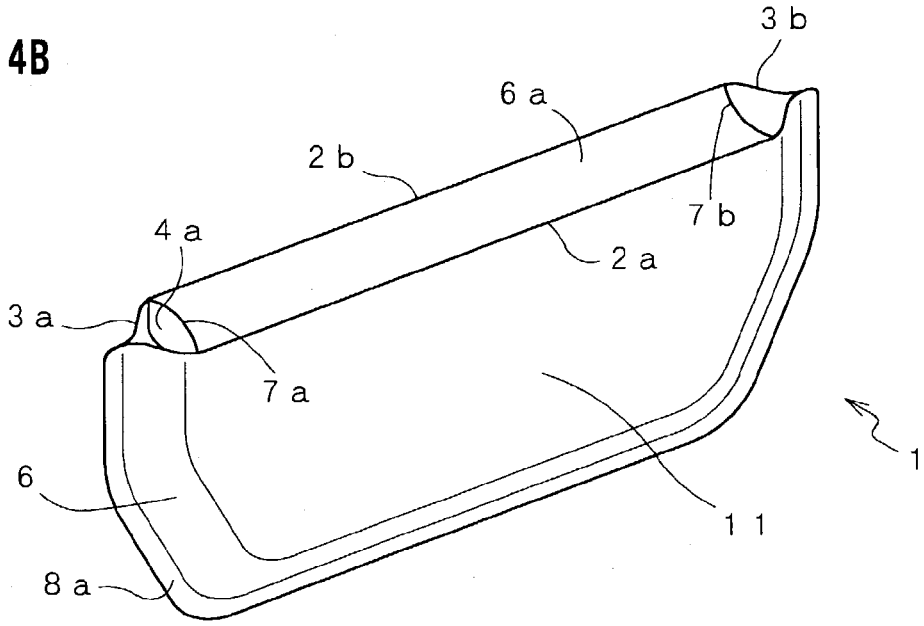
FIG. 4B is a perspective view showing a closed state of the packaging case of FIG. 4A.

As a variation of the aforementioned embodiment, as shown in FIGS. 4A, 4B, each of the bend lines 7*a*, 7*b* for bending the inner fins 4*a*, 4*b* may comprise an arc. Thus, falling down of the inner fins 4*a*, 4*b* when putting the contents in the packaging case 1 can be eliminated.

Figure 5A:
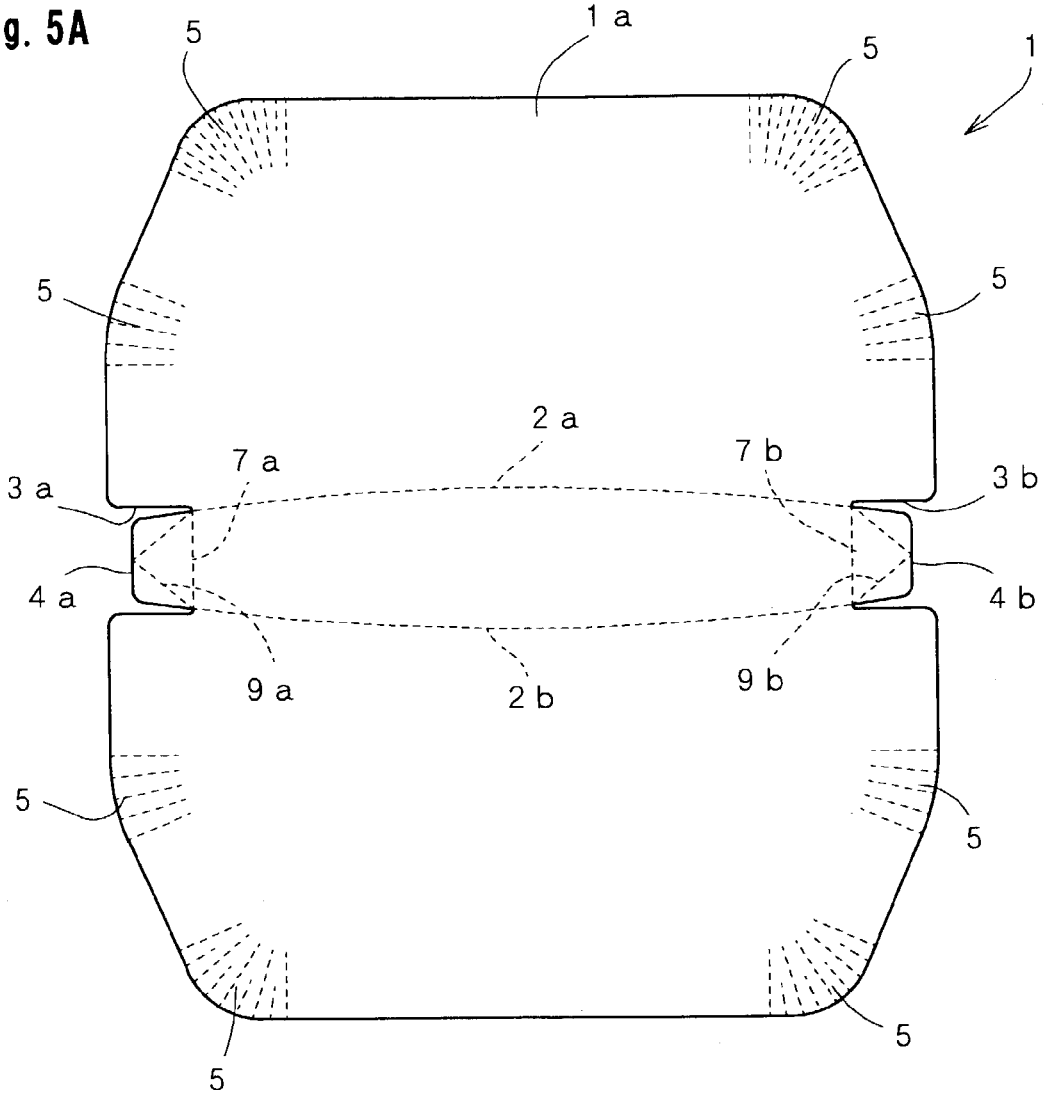
FIG. 5A is a developed view showing a variation of the packaging case of FIG. 1.
Figure 5B:
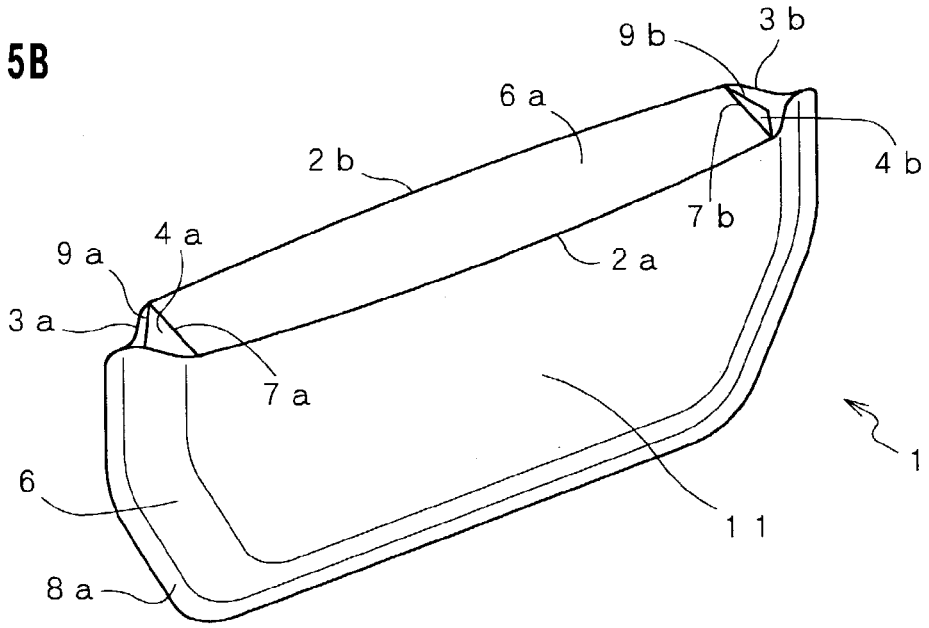
FIG. 5B is a perspective view showing a closed state of the packaging case of FIG. 5A.

Furthermore, as shown in FIGS. 5A, 5B, each of the fold lines 2*a*, 2*b* may also comprise an arc, preventing the packaging case 11 from being naturally opened when removing the fastening means. In this case, further crease lines 9*a*, 9*b* may be formed on the inner fin 4*a*, 4*b* so that the crease lines 9*a* (9*b*) and the bend line 7*a* (7*b*) make a triangle. Thus, a space made by edges of the incision 3*a* and the bend line 7*a* and a space made by edges of the incision 3*b* and the bend line 7*b* are almost completely covered with the inner fins 4*a*, 4*b*, respectively, when the packaging case 1 is closed.

Figure 6A:
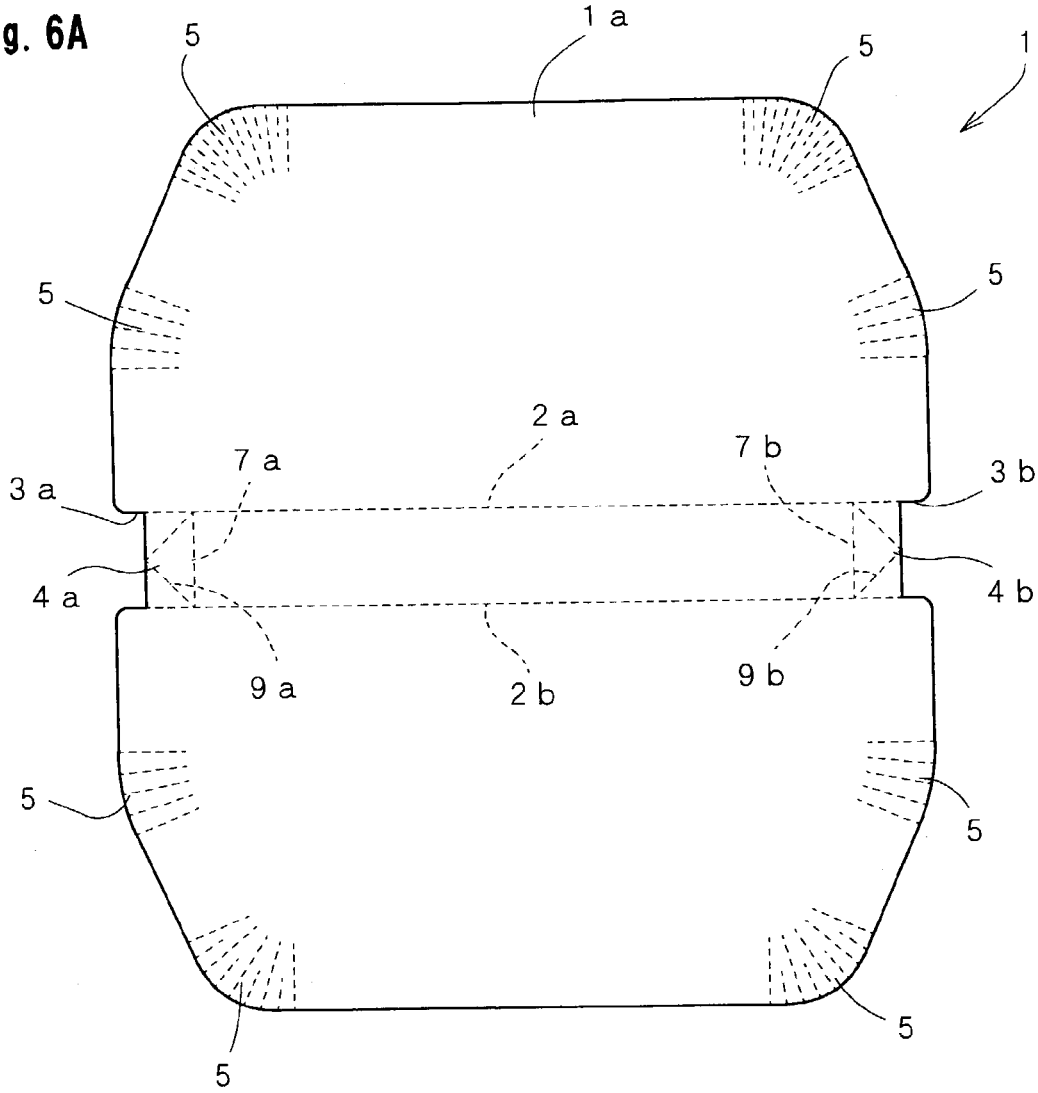
FIG. 6A is a developed view showing a variation of the packaging case of FIG. 1.
Figure 6B:
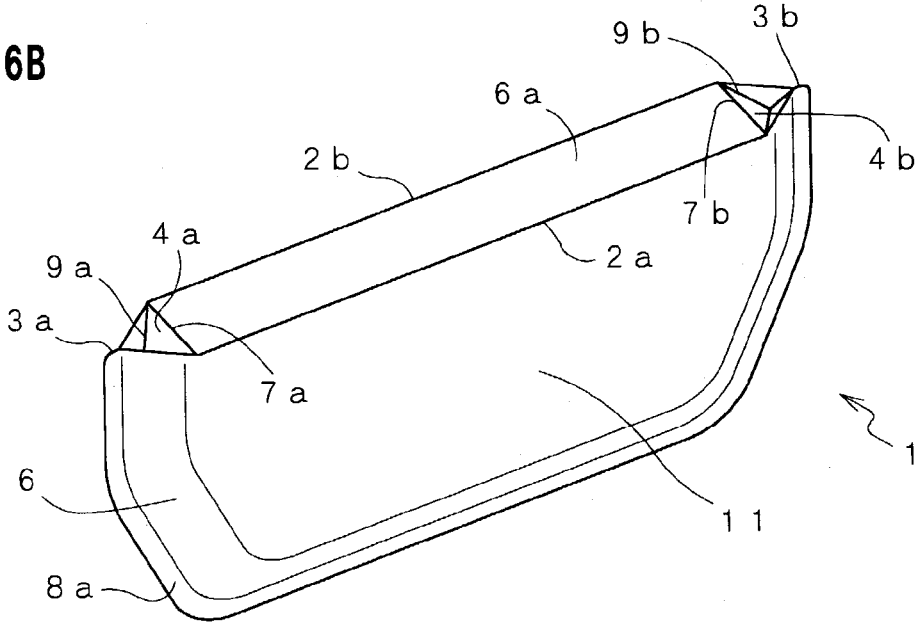
FIG. 6B is a perspective view showing a closed state of the packaging case of FIG. 6A.

As an another variation of the aforementioned embodiment, as shown in FIGS. 6A, 6B, the incisions 3*a*, 3*b* may be formed only on positions where the rims 8*a*, 8*b* are formed, increasing the rigidity of the packaging case 1.

Figure 7A:
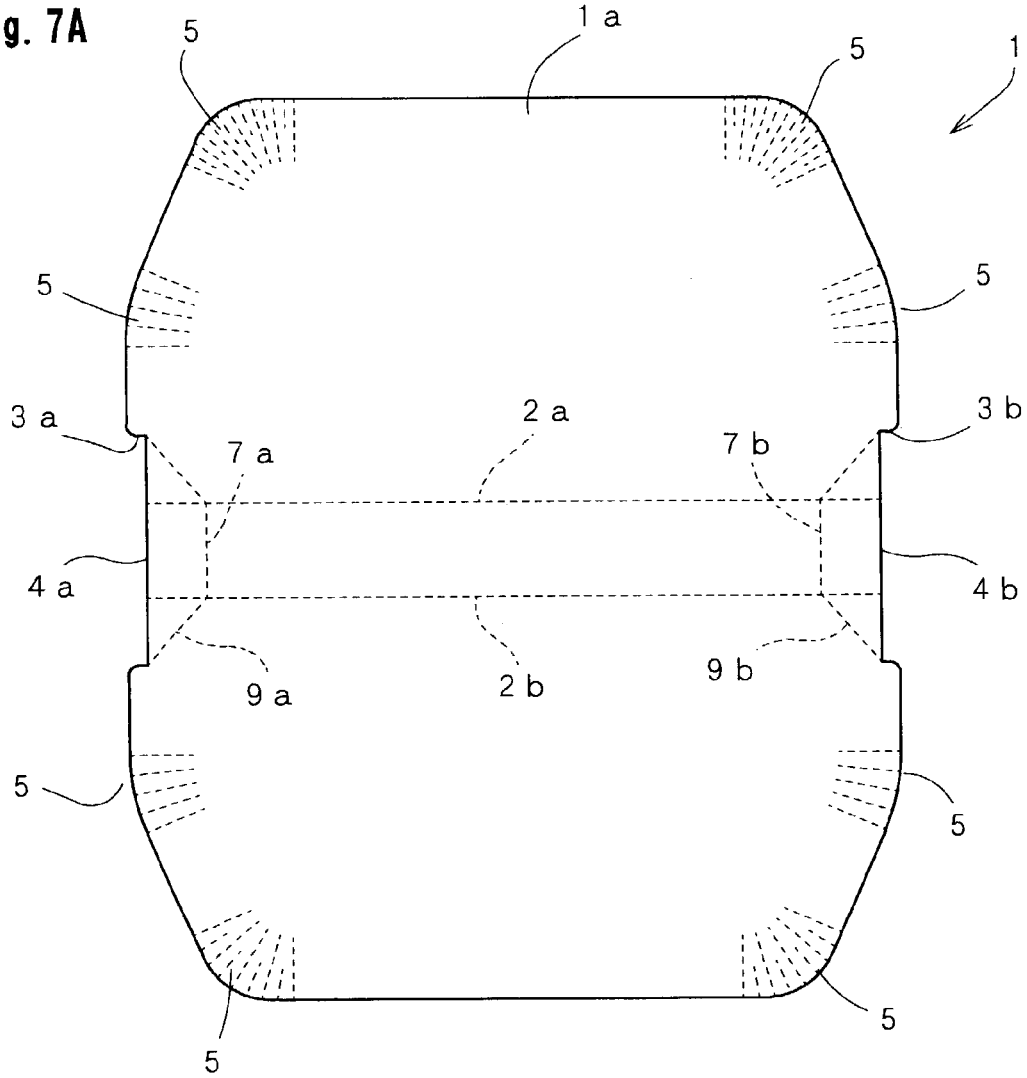
FIG. 7A is a developed view showing a variation of the packaging case of FIG. 1.
Figure 7B:
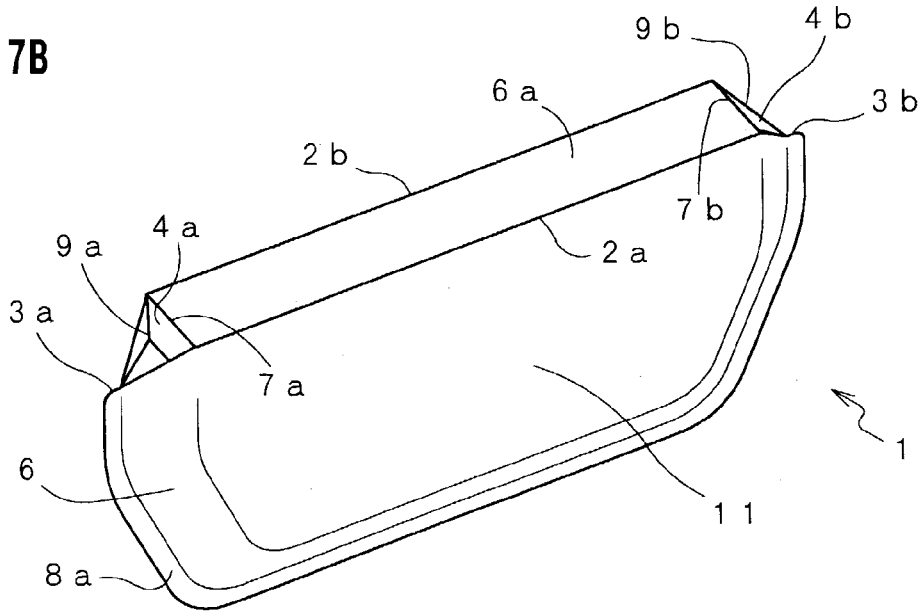
FIG. 7B is a perspective view showing a closed state of the packaging case of FIG. 7A.

As shown in FIGS. 7A, 7B, incisions 3*a*, 3*b* of which width are wider than a distance between fold lines 2*a*, 2*b* and crease lines 9*a*, 9*b* which extends from both ends of the bend lines 7*a*, 7*b* to the corners of the incisions 3*a*, 3*b* may be formed so that the packaging case 1 can be substantially completely sealed.

Figure 8A:
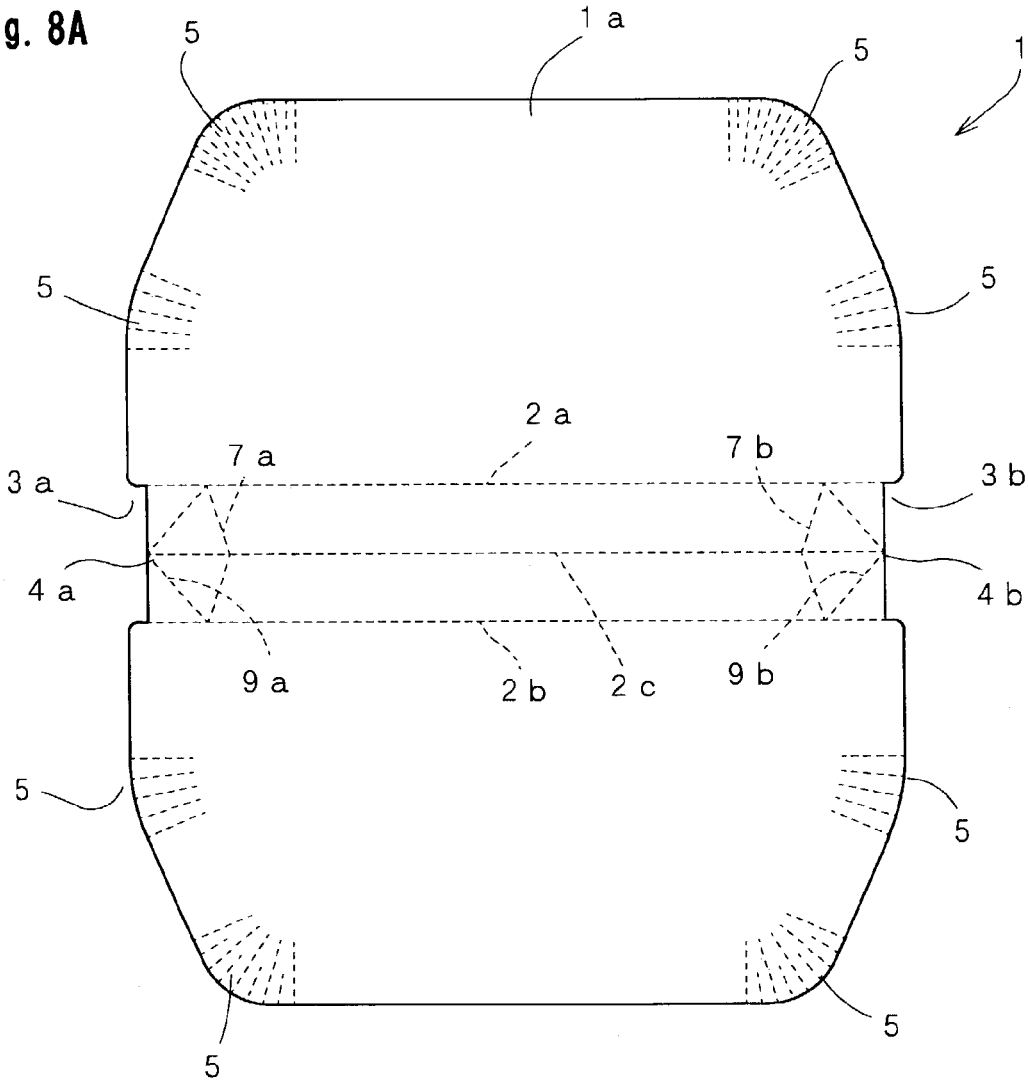
FIG. 8A is a developed view showing a variation of the packaging case of FIG. 1.
Figure 8B:
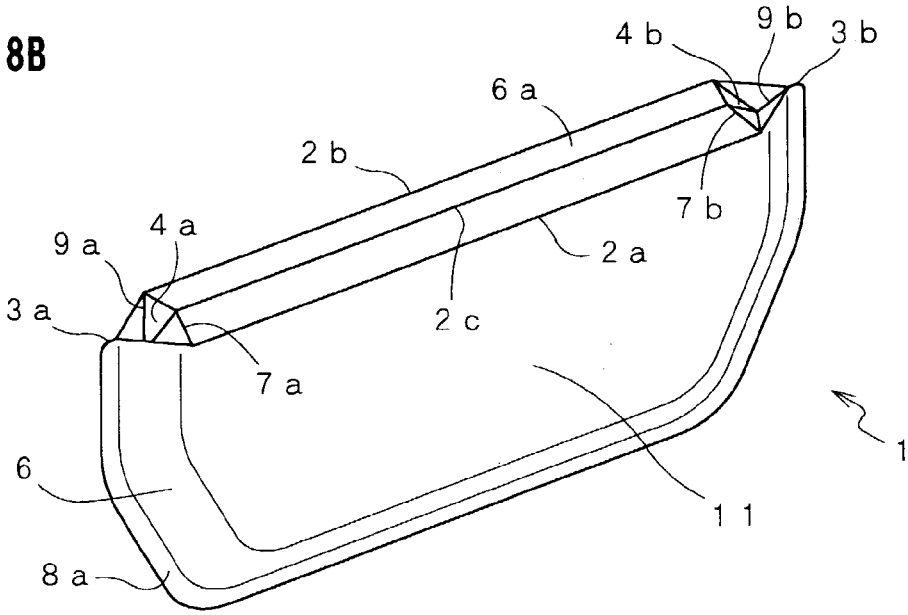
FIG. 8B is a perspective view showing a closed state of the packaging case of FIG. 8A.

Also, as shown in FIGS. 8A, 8B, the bend lines 7*a*, 7*b* may be knuckled toward the center of the unitary blank 1*a*. Three crease lines 9*a*, 9*b* extending from the edge of the inner fins 4*a*, 4*b* to both ends of the bend lines 7*a*, 7*b* and knuckled point of the bend lines 7*a*, 7*b* may be formed. A fold line 2*c* positioned between the fold lines 2*a*, 2*b* and extending between knuckled point of the bend lines 7*a*, 7*b* may be added. Thus, the inner space of the packaging case 1 becomes larger.

Figure 9:
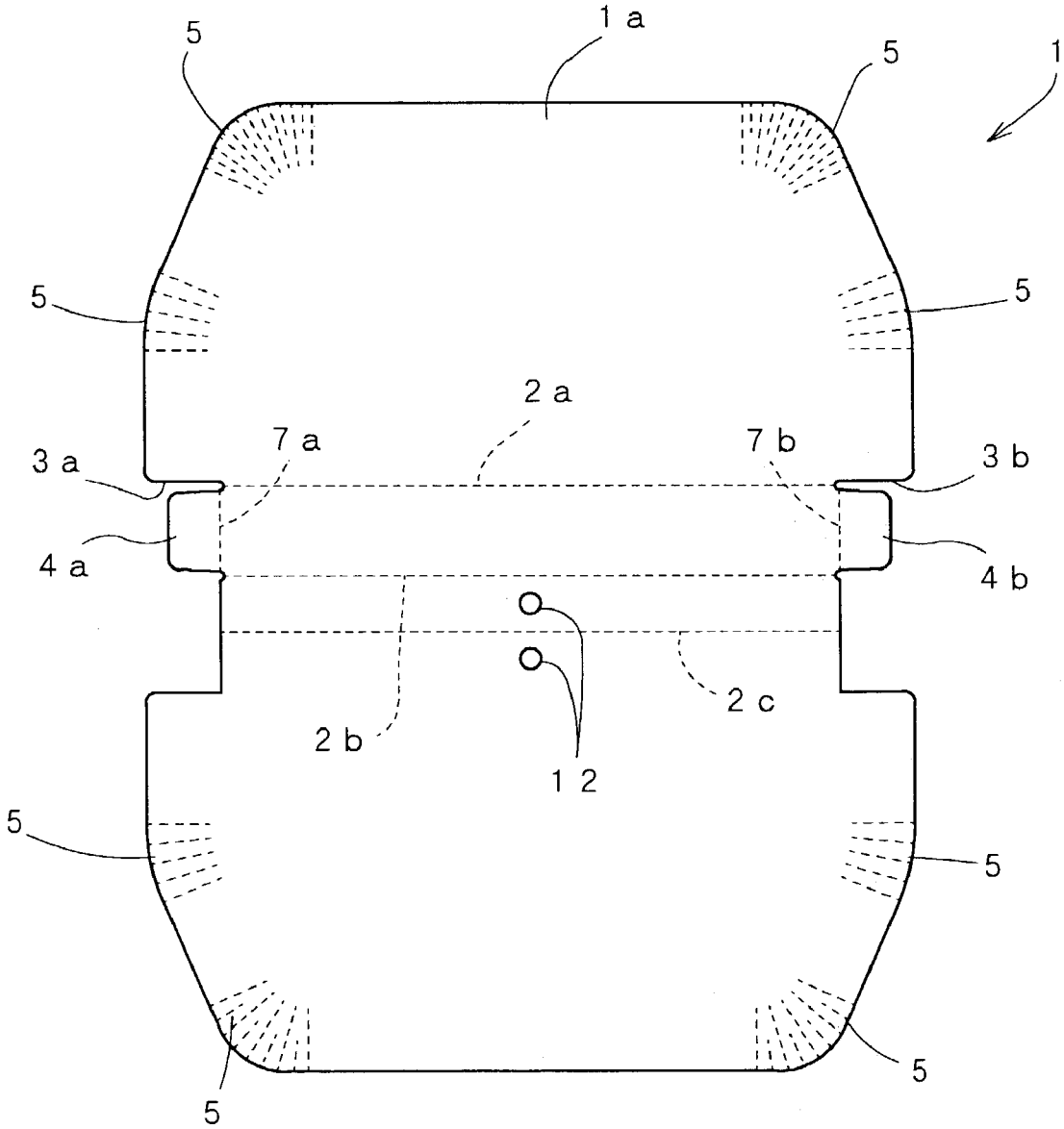
FIG. 9 is a developed view showing a variation of the packaging case of FIG. 1.
Figure 10:
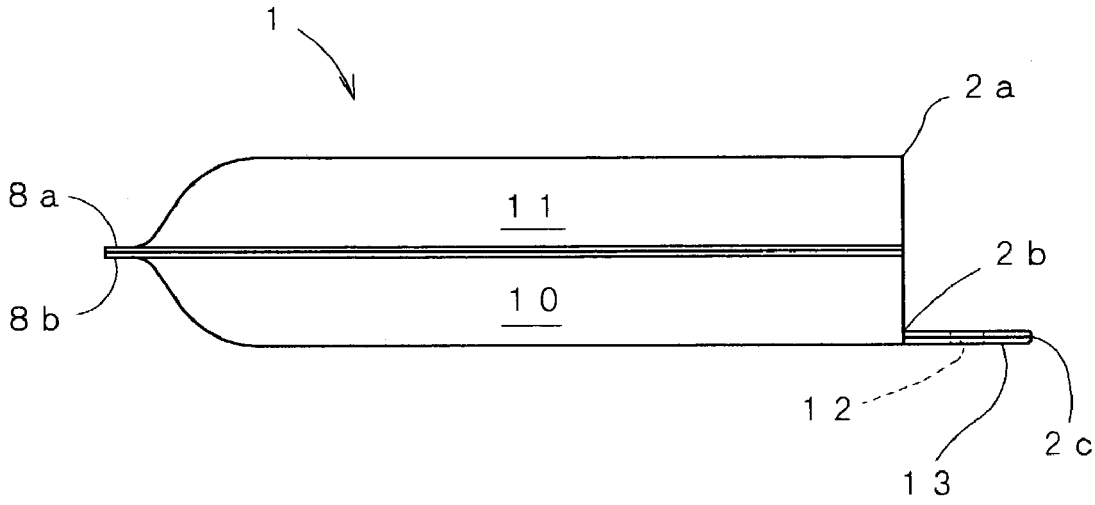
FIG. 10 is a side view showing a closed state of the packaging case of FIG. 9.

As a still another variation of the aforementioned embodiment, as shown in FIG. 9, a fold line 2*c* may be added adjacent to the fold line 2*b*, portions of the incisions 3*a*, 3*b* positioned on the extension of the fold line 2*b* may have a width twice the distance between the fold lines 2*b*, 2*c*, and perforated holes 12 may be formed on both side of the fold line 2*c*. When folding this packaging case 1, as shown in FIG. 10, a header 13 with the perforated hole 12 is formed so that the perforated hole 12 can be engaged with a hook of a display rack to display the packaging case 1.

Figure 11:
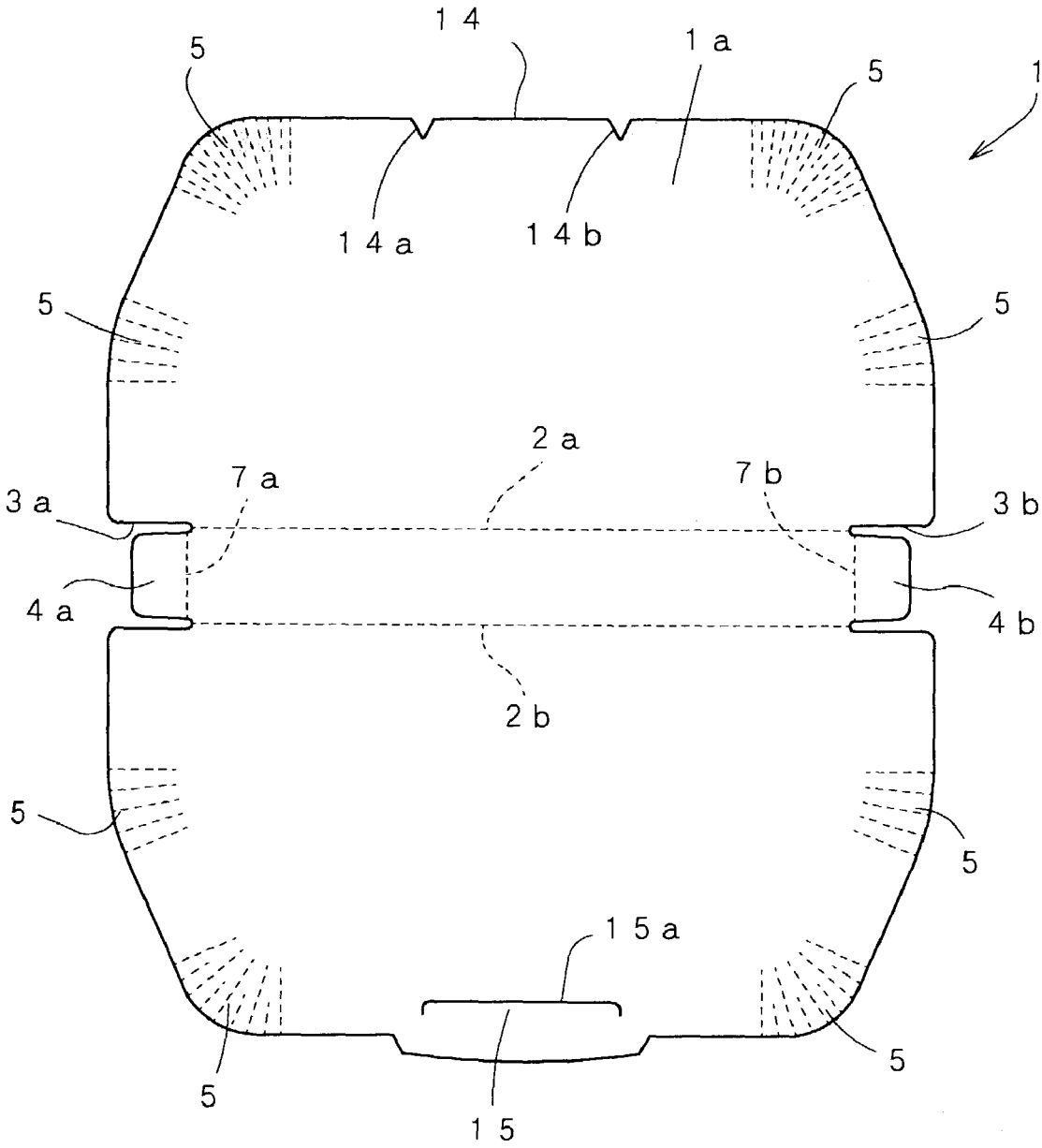
FIG. 11 is a developed view showing a variation of the packaging case of FIG. 1.
Figure 12:
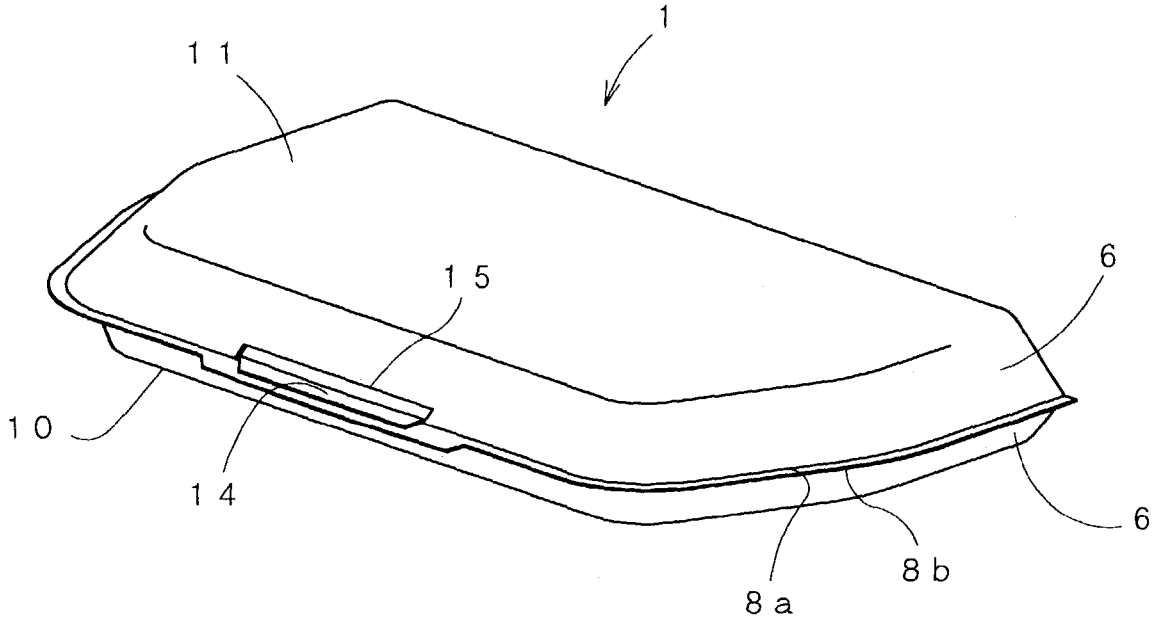
FIG. 12 is a side view showing a closed state of the packaging case of FIG. 11.

As a still another variation of the aforementioned embodiment, as shown in FIG. 11, an engaging tab 14 and an engaging-tab receiving portion 15 may be provided on the center portion of the rims 8*a*, 8*b* of the packaging case 1. The engaging tab 14 can be formed by making incisions 14*a*, 14*b* on the outer periphery of the rim 8*a*, 8*b*, while the engaging-tab receiving portion 15 can be formed by making a incision line 15*a* on an opposite portion of the rim 8*a*, 8*b* to the engaging tab 14. As shown in FIG. 12, the rims 8*a*, 8*b* of the packaging case 1 are put together and the engaging tab 14 is engaged with the engaging-tab receiving portion 15, allowing the packaging case to be maintained in a closed condition.

In the above embodiment and its variations, although the shape of the packaging case 1 have a substantially rectangular shape, it may have a substantially square shape or a substantially semicircle shape.

The unitary blank 1*a* of the packaging case 1 is not limited to the E-fluted corrugated board but may be a thick paper material having a thickness of more than 1.5 mm or a thin paper material such as a single paper. Also, it may be a single-faced corrugated board.

As clear from the above description, according to the present invention, a packaging case can be easily made by folding the unitary blank along the fold lines.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A packaging case formed of a unitary blank of paper material comprising a bottom wall, a top wall and a back side wall connecting the bottom wall and the top wall, the unitary blank having:

(A) at least two fold lines between which the back side wall is formed and both sides of which the bottom wall and the top wall are formed;

(B) a plurality of score lines formed on the corner portions of the outer periphery of the unitary blank, the plurality of score lines being perpendicular to the edge of the unitary blank at the corner portions; and (C) incisions formed on both ends of each of the fold lines;

the packaging case being formed by deep drawing the unitary blank, the packaging case comprising:

the bottom wall;

the top wall;

the back side wall;

a first side wall formed on the periphery of the bottom wall;

a second side wall formed on the periphery of the top wall;

a single first rim protruding outwardly from the upper end of the first side wall and being continuous substantially along the entire length of the first side wall; and a single second rim protruding outwardly from the upper end of the second side wall and being continuous substantially along the entire length of the second side wall;

and the packing case is folded along the fold lines so that the first and second rims come into contact with each other, whereby the bottom wall, the top wall, the back side wall and the first and second side walls constitute an inner space.

2. A packaging case as in claim 1, wherein bend lines connecting the fold lines are formed on the both end portions of the back side wall, whereby inner fins are formed outside the bend lines.

3. A packaging case as in claim 2, wherein the incisions extend to the bend lines.

4. A packaging case as in claim 1, wherein each of the bend lines comprises an arc.

5. A packaging case as in claim 3, wherein crease lines are formed on the inner fin so that the crease lines and the bend line make a triangle.

6. A packaging case as in claim 5, wherein each of the fold lines comprises an arc.

7. A packaging case as in claim 2, wherein crease lines are formed on the inner fin so that the cease lines and the bend line make a triangle.

8. A packaging case as in claim 2, wherein the width of the incisions are wider than a distance between fold lines, and crease lines extending from both ends of the bend lines to the corners of the incisions are formed.

9. A packaging case as in claim 2, wherein the bend lines are knuckled toward the center of the unitary blank three crease lines extending from the edge of the inner fins to both ends of the bend lines and knuckled point of the bend lines are formed, and a fold line positioned between the fold lines and extending between knuckled point of the bend lines is added.

10. A packaging case as in claim 2, wherein a fold line is added adjacent to the fold line, portions of the incisions positioned on the extension of the fold line have a width twice the distance between the fold lines, and perforated holes are formed on both sides of the fold line.

11. A packaging case as in claim 1, wherein an engaging tab and an engaging-tab receiving portion are provided on the center portion of the rims.

12. A packaging case as in claim 11, wherein the engaging tab is formed by making incisions on the outer periphery of the rims, the engaging-tab receiving portion is formed by making a incision line on an opposite portion of the rims to the engaging tab.

13. A packaging case as in claim 1, wherein the unitary blank is made of corrugated board.

* * * * *